United States Patent [19]

Kobayashi

[11] Patent Number: 4,806,096

[45] Date of Patent: Feb. 21, 1989

[54] BACK-FIRE PREVENTIVE UNIT IN A GAS CUTTING TORCH

[75] Inventor: Souji Kobayashi, Kawaguchi, Japan

[73] Assignee: Taseto Co., Ltd., Japan

[21] Appl. No.: 57,793

[22] Filed: Jun. 3, 1987

[30] Foreign Application Priority Data

Jun. 4, 1986 [JP] Japan ..... 61-130891
Oct. 29, 1986 [JP] Japan ..... 61-259551
Jan. 12, 1987 [JP] Japan ..... 62-5774

[51] Int. Cl.[4] ..... F23D 14/82

[52] U.S. Cl. ..... 431/346; 48/192; 266/48

[58] Field of Search ..... 431/346; 48/192; 266/48

[56] References Cited

U.S. PATENT DOCUMENTS 1,176,017 3/1916 Armstrong ..... 431/346
1,290,422 1/1919 Vale et al. ..... 431/346
2,095,747 10/1937 Jacobsson ..... 431/346
3,031,285 4/1962 Hedberg ..... 48/192
3,035,632 5/1962 Ericsson ..... 431/346
3,243,272 3/1966 Schmitz ..... 48/192

FOREIGN PATENT DOCUMENTS 1211563 3/1966 Fed. Rep. of Germany ..... 431/346

*Primary Examiner*—Carroll B. Dority, Jr.
*Attorney, Agent, or Firm*—McGlew and Tuttle

[57] ABSTRACT

A manual gas cutting torch to be used for fusion-cutting iron materials such as steel frames or iron plates includes a flame port at its cutting tip, a plurality of ports connected with gas and oxygen cylinders at its rear edge, and a handle section for holding the torch with one hand at its middle. A freely detachable back-fire preventive device is incorporated into a gas channel or oxygen channel or to both channels which shift(s) to the cutting tip side from this handle section. The back-fire preventive device serves to stop any flash-back from the cutting tip just before the handle section for preventing the flame from passing through the handle section and escaping back to the cylinder.

6 Claims, 4 Drawing Sheets

BACK-FIRE PREVENTIVE UNIT IN A GAS CUTTING TORCH

BACKGROUND OF THE INVENTION

Field of the Invention

This invention relates particularly to a back-fire preventive unit for a gas cutting torch for fusion-cutting of metal frames and plates by ejecting out of a cutting tip a mixed gas obtained by mixing a fuel gas and oxygen for igniting it, and thus by utilizing the flames which have been built up on the cutting tip.

In a manual gas cutting torch, a flame port is formed at its tip, a handle section for holding the torch with one hand is formed at the middle, and the connection ports with gas and oxygen cylinders are built up at the rear section, or in many cases, at the rear end of said handle, to whose connection port and handle section the adjusting valves for regulating the flowrate of gas and oxygen are fitted.

The manual gas cutting torch in this way serves to help an operator to hold it with his one hand for performing the fusion-cutting work while moving it freely. However, flash-backs sometimes happen in this type of gas cutting torch. A back-fire phenomenon occurs when the jet speed "Uf" of mixed gases and oxygen becomes smaller than the combustion speed "Sb" of the mixed gases while the relation between them usually remains at Uf=Sb. A back-fire is usually found when regulating the gas and oxygen volumes or when extinguishing the fire. The biggest reason for the back-fire to happen in such a case is that the equilibrium between the jet speed "Uf" and the combustion speed "Sb" of mixed gas is disturbed by the adjustment of gas and oxygen, and the value of "Uf" frequently becomes smaller.

Should a back-fire happen in a gas cutting torch, this back-fire runs back up to the gas or oxygen cylinder which might explode.

Therefore, in the past to avoid the possibility of explosion a fire preventive unit is attached to the outlet port of the cylinder or to the hose connecting the cylinder with the gas cutting torch. However, this type of conventional means is not satisfactory for the operator's safety although it can prevent the cylinder from exploding.

In many cases the operator holds the gas cutting torch in his one hand during work with the other effective hand, and while, adjusting the gas or oxygen, he holds the gas cutting torch with the hand opposite to his effective hand. For this reason, once a back-fire should happen, this gas cutting torch instantaneously becomes high in temperature and his one hand is burned. Also, due to this instantaneous high temperature he sometimes drops the gas cutting torch from his hand, and this is especially dangerous when dropping the gas cutting torch from a high place. Further, there may be an explosion to the handle section which incorporates a valve for adjusting the gas or oxygen. In case of this explosion, a serious injury may be invited to the operator's body in addition to the burn to his hand or a part of his body.

SUMMARY OF THE INVENTION

The invention provides a back-fire preventive unit in a gas cutting torch, for protecting an operator using the gas cutting torch from suffering from a burn.

The various features of novelty which characterize the invention are pointed out with particularity in the claims annexed to and forming a part of this disclosure. For a better understanding of the invention, its operating advantages and specific objects obtained by its uses, reference is made to the accompanying drawings and descriptive matter in which preferred embodiments of the invention are illustrated.

DESCRIPTION OF THE PREFERRED EMBODIMENTS

Figure 1:
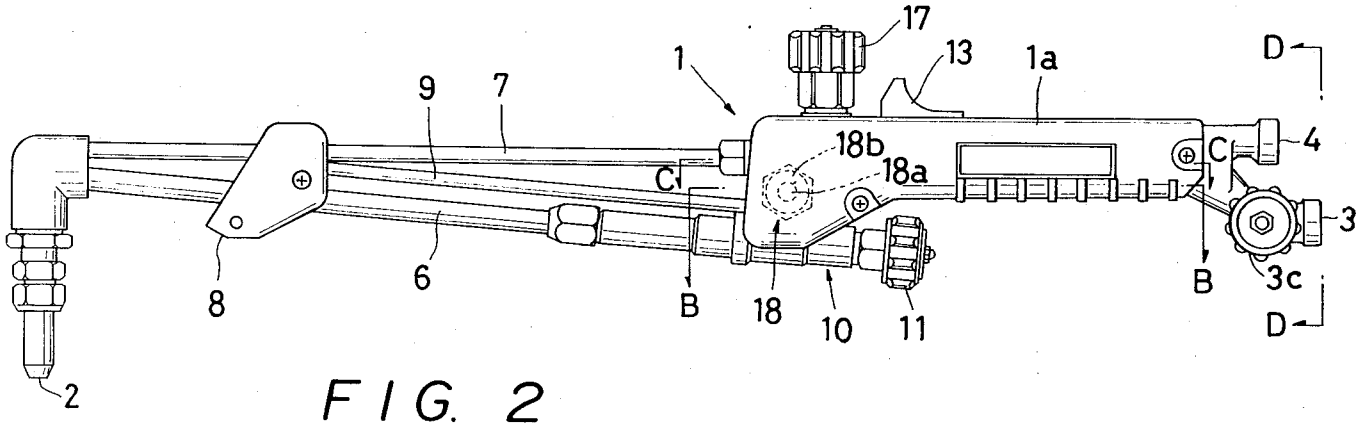
FIG. 1 is a side elevational view of a gas cutting torch constructed in accordance with the invention.
Figure 2:
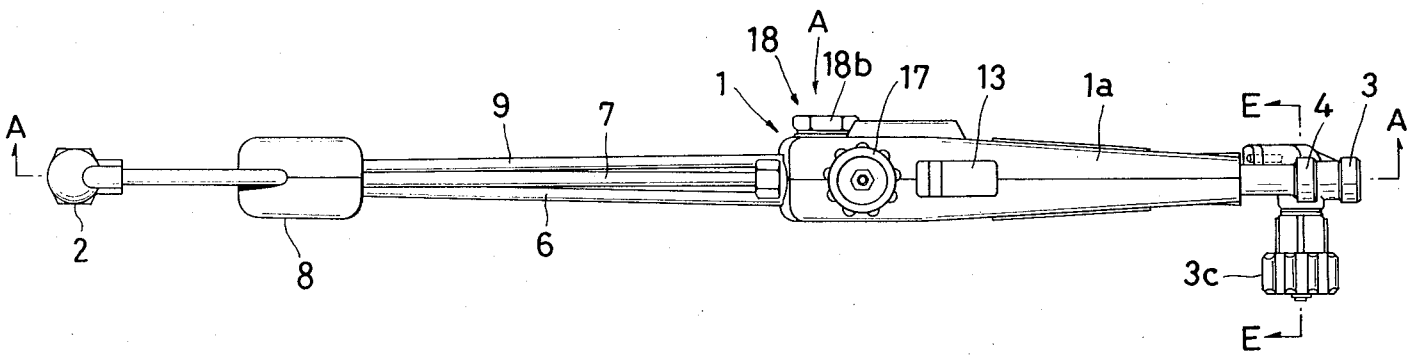
FIG. 2 is a top plane view of the gas cutting torch of FIG. 1.
Figure 3:
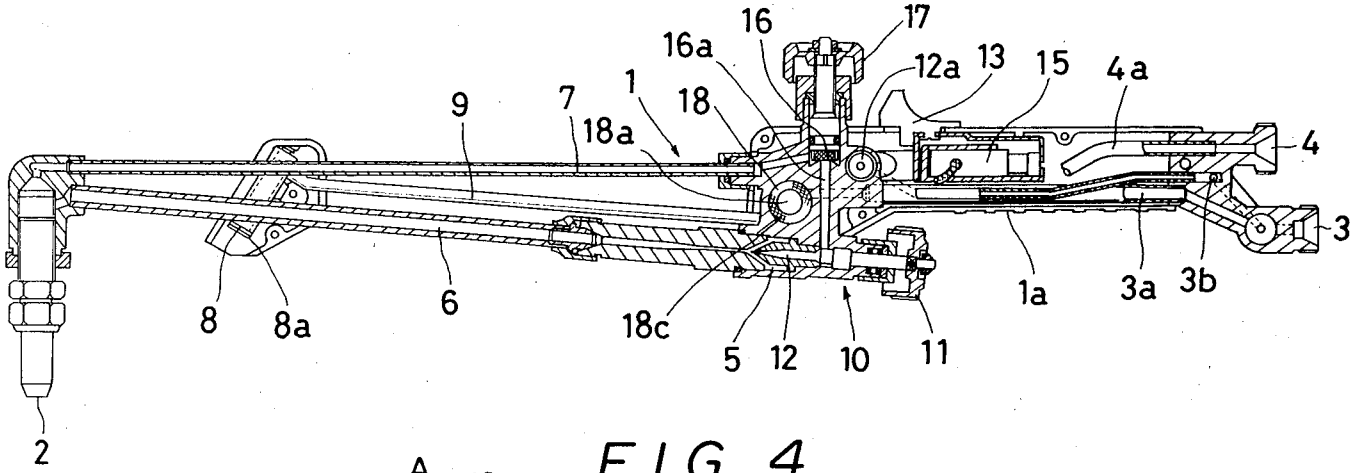
FIG. 3 is a sectional view taken along the line A—A of FIG. 1.
Figure 4:
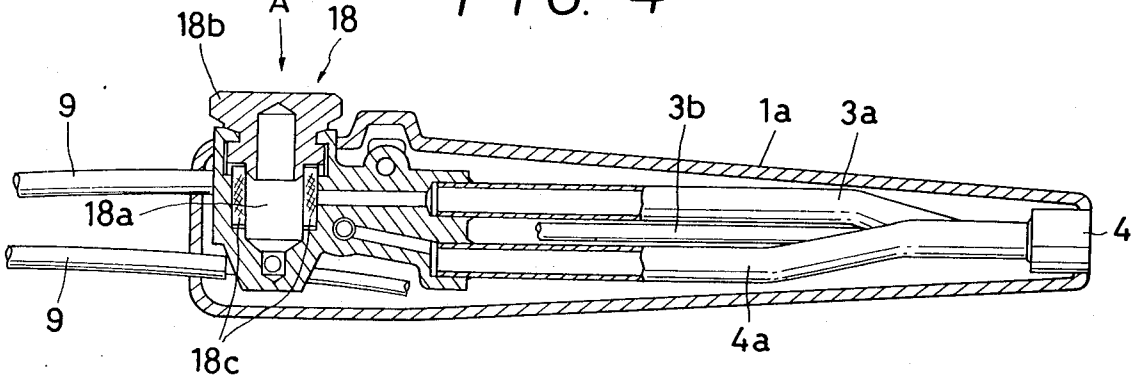
FIG. 4 is a sectional view taken along the line b—b of FIG. 1.

A back-fire preventive unit in a gas cutting torch 1 according to this invention is built into the manifold block A area of FIG. 2 in front of the handle section of a gas cutting torch. The gas cutting torch 1 is equipped with a cutting tip 2 at its tip, and is provided with the gas supply port or connection port 3 and an oxygen supply port or connection port 4 respectively at its rear edge for supplying gas and oxygen to the aforesaid cutting tip 2, but also is structured in such a manner that the gas and oxygen which have entered from the gas supply port 3 and the oxygen supply port 4 may be fed through bores formed in the manifold block to a mixture chamber 5 (FIG. 9) formed in the manifold block adjacent a lower face and opening to the rear face in front of the handle 1*a* via the gas passage 3*a* and the oxygen passage 4*a* which connect at a rear face of the manifold block to bores found therein. The passages leading to the cutting tip 2 from the mixture chamber 5 are interconnected to each other by use of the mixed gas channel 6 provided by a pipe extending from the front face of the manifold through the cutting tip. A further branching of the oxygen entering from the oxygen supply port 4 is effected to a side of branched jet gas passage or bore 16*a* inside the handle section 1*a*. A jet gas passage 7 supplies the oxygen directly into the cutting tip 2 from the front face of the manifold, where the gas entered from the gas supply port 3 is branched by the branched gas passage 3*b* in the downstream side of supply port 3. Gas is supplied also via a pilot gas channel 9 provided by a pipe extending from the front face of the manifold through the cutting tip (FIGS. 3 and 4), to a pilot fire port 8 attached to the vicinity of cutting tip 2.

A needle valve 10, which extends behind the rear face of the block under the handle, is capable of optionally setting the mixed gas flowrate passing through the interior of the mixed gas channel 6 by means of the knob 11.

Figure 5:
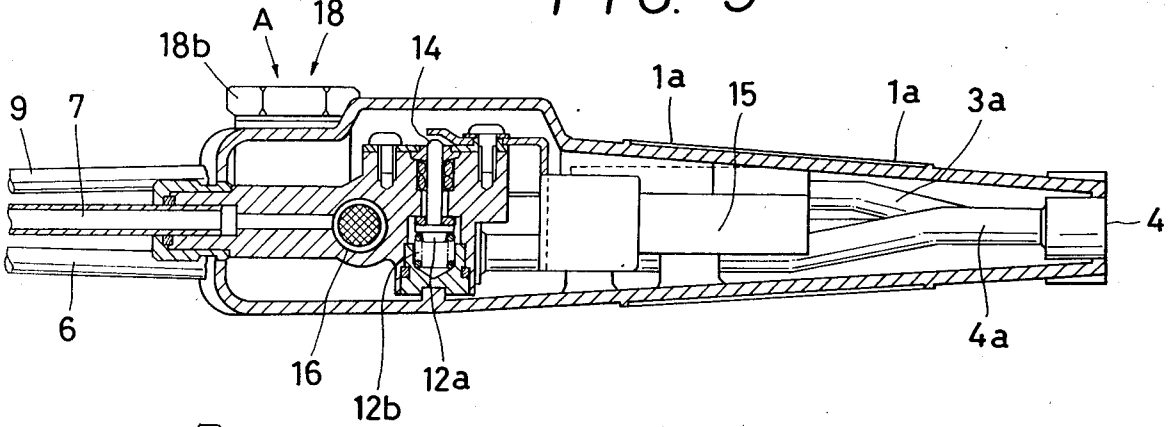
FIG. 5 is a sectional view taken along the line C—C of FIG. 1.
Figure 7:
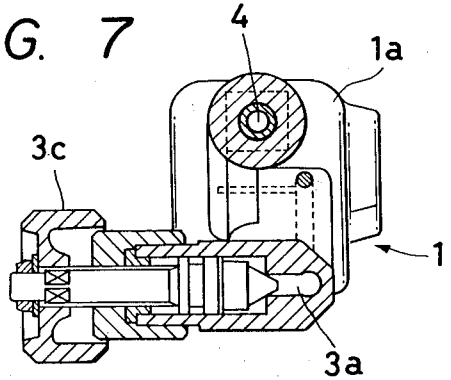
FIG. 7 is the sectional view taken along the line E—E of FIG. 2.
Figure 6:
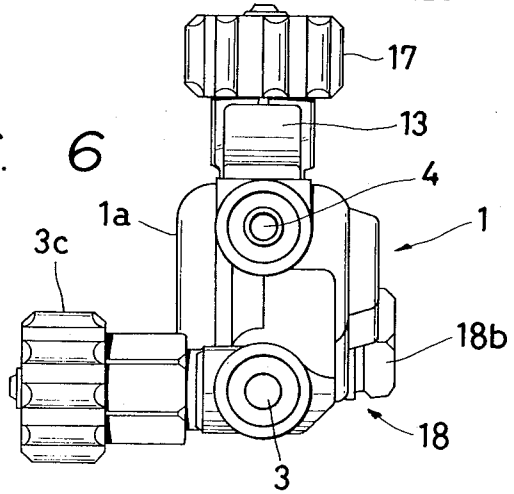
FIG. 6 is a front elevation viewed from the direction of the line D—D of FIG. 1.

FIG. 5 indicates a pilot gas control valve 12*a*, which is mounted in a chamber formed in the block adjacent a rear face thereof and connected to the branched gas passage 3*b*.

An ignition lever button 13 protrudes above the upper face of handle section 1*a* and is structured so that when it is pushed in, the pilot gas control valve 12*a* is opened by the spindle 14 and can be automatically returned by a return spring 12*b*.

A piezoelectric type ignition unit 15 discharges electricity between electrodes 8*a* of the pilot fire port 8 is mounted in a chamber formed in the manifold block opening to the upper face of the block and when the pilot gas control valve 12*a* is opened by use of the said ignition lever 13.

A jet gas valve 16 is mounted in a chamber formed in the manifold block opening to the upper face of the block and controlled by a knob 17 fitted to the handle section 1*a*, which is mounted to the branched jet gas passage or bore which interconnects oxygen passages 4*a* and 7, 16 in order to regulate the flowrate of jet gas passing through the inside of the jet gas passage 7.

Figure 9:
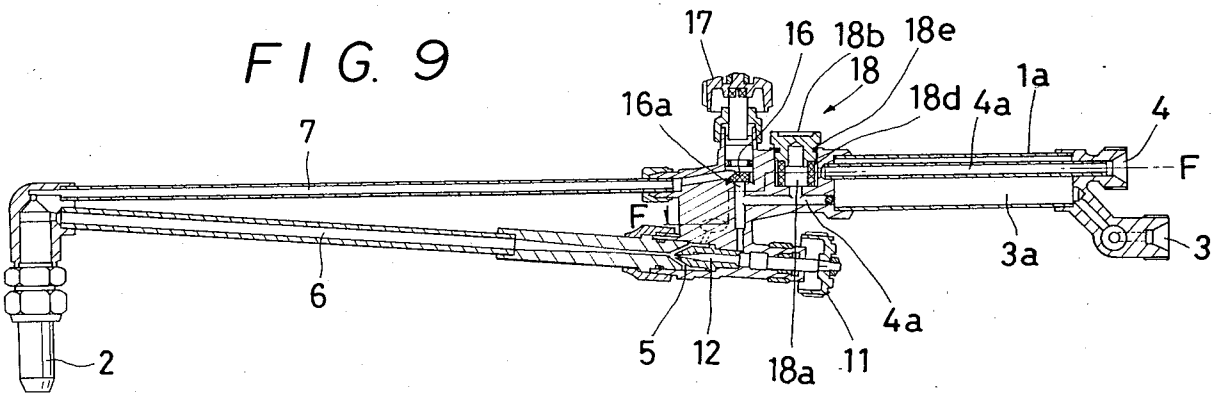
FIG. 9 is cross sectional view of another embodiment of gas cutting torch indicating the state incorporating the back-fire preventive device inside the oxygen passage.
Figure 8:
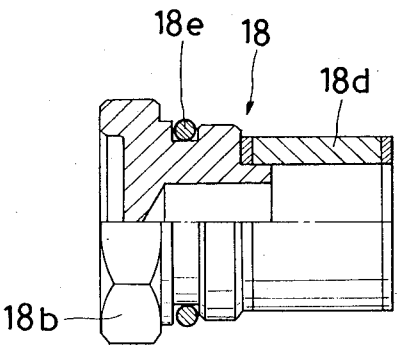
FIG. 8 is a side elevational view partly in section of the backfire preventive device.

A back-fire preventive unit 18 is releasably mounted in a chamber 18*a* formed in the manifold open to a lateral face thereof and includes a back-fire preventive device 18*c* of cylindrical wire net shape (FIG. 4) by utilizing the fixture 18*b* inside the chamber 18*a* formed in a bore connecting gas passage 3*a* with gas mixture chamber 5 on the downstream side of handle section 1*a*. The back-fire preventive device 18*c* of wire net shape can be replaced by a back-fire preventive device 18*d* made of sintered metal as illustrated in the embodiment of FIG. 8. The back-fire preventive device can also be of the combination of heat resistant materials, for example, such metals high in melting point as stainless steel or tungsten or other ceramics or the materials. The back-fire preventive device exemplified in the embodiments have the advantage in practical application that they may be capable of freely setting the area (size) of said device meeting the gas (or oxygen) volume. In FIG. 8 and FIG. 9 an O-ring is shown for sealing the backfire device in position.

A practical use example of the gas cutting torch is described below:

First, connect the gas supply port 3 and the oxygen supply port 4 respectively to the gas and the oxygen cylinders using hoses. Open the valves on the side of respective cylinders, further open the knob 3*c* for supplying the gas and the oxygen which then enter into the mixture section 5 via the gas passage 3*a* and the oxygen passage 4*a* and are mixed therein. This mixed gas adjusted by the needle valve 10.

Next, push in the ignition lever 13, open the pilot gas control valve 12*a* for supplying the gas to the pilot fire port 8, and at the same time control the piezoelectric ignition unit 15 for allowing a spark discharge between the electrodes 8*a* and for igniting the pilot fire port 8.

The mixed gas which has been mixed in the mixture section 5 is fed to the cutting tip 2 via the mixed gas channel 6 and is jetted out. A fire is shifted to this jetted mixed gas from the flame of pilot fire port 8 which has been previously ignited. After this fire shift, the operators hand is released from the ignition lever 13, then the lever 13 is automatically returned by the return spring, and the flame of the pilot fire port 8 goes out. In the next step, the needle vale 10 for mixed gas is controlled for regulating the fire intensity and for performing the preheating in advance to the cutting work by use of the flame which has been produced on the cutting tip 2.

When the preheating work is over, the jet gas valve 16 is opened by means of a knob 17 for supplying the jet gas to the cutting tip 2 through the jet gas passage 7 so as to form an intensive flame for cutting service, on the cutting tip 2. The cutting work is not ready to be conducted.

When the work is through, close all the valves respectively. For reference, as a procedure for setting a fire to the cutting tip 2, it is permissible to have the mixed gas jetted out first from the cutting tip 2 and to have a pilot flame formed for setting a fire to the cutting tip 2 at a later stage.

The back-fire preventive unit 18 serves to prevent the flashback from entering into the gas passage 3*a* inside the handle section 1*a*. via the mixed gas channel 6 from the side of cutting tip 2. This is to say, in the section of the back-fire preventive device 18*c* of wire net shape or the back-fire preventive device 18*d* made of sintered metal, the gas flowrate becomes quicker than the combustion speed and thus the back-fire is checked. Further, being cooled down by the back-fire preventive device 18*c* of wire net shape or the back-fire preventive device 18*d* made of sintered metal, the combustion speed goes down, thereby the back-fire is prevented.

If carbon has become stuck to the back-fire preventive device 18*a* of wire net shape or to the back-fire preventive device 18*d* made of sintered metal with subsequent increased resistance in gas flowrate, slacken the retainer 18*b* for taking out the back-fire preventive device 18*c* of wire net shape or the back-fire preventive device 18*d* made of sintered metal and replace it with a new one, or flush it clean.

Figure 10:
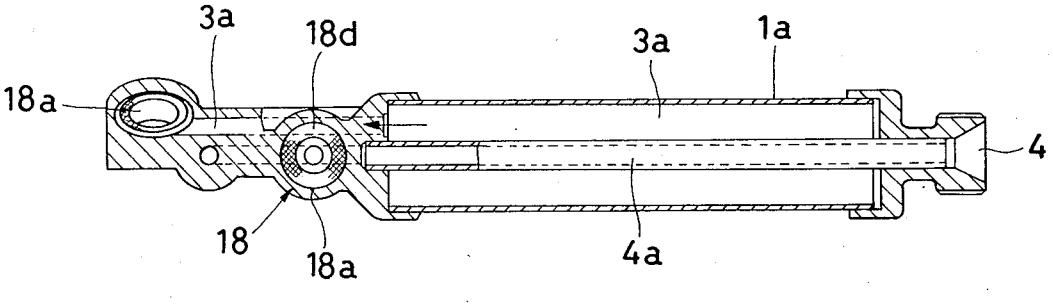
FIG. 10 is the sectional view taken along the line F—F of FIG. 9.

FIG. 9 and FIG. 10 illustrates an embodiment example where the back-fire preventive units 18 have been mounted both to the gas passage 3*a* side and the oxygen passage 4*a* side, and serves to prevent the back-fire from running back to the handle section 1*a* side through the oxygen passage 4*a* side. What's more, this embodiment example in FIG. 9 and FIG. 10 represents the gas cutting torch having no pilot fire port for ignition. Next, the back-fire preventive unit 18 can be attached to the gas passage 3*a* side or the oxygen passage 4*a* side as shown in the embodiment example, or the units may be mounted orthogonally in bores connecting to the sides if so necessary.

According to this invention, the back-fire does not pass through the interior of the handle section since the back-fire preventive unit or units has or have been incorporated into the gas passage or the oxygen passage or both the gas passage and oxygen passage on the downstream side of the interior of the handle section as mentioned earlier. As a result the handle section can not get overheated and burn an operator nor cause explosion. Therefore, at a time of the flashback which usually happens with a gas cutting torch, the operator is protected.

While specific embodiments of the invention have been shown and described in detail to illustrate the application of the principals of the invention, it will be understood that the invention may be embodied otherwise without departing from such principals.

What is claimed is:

1. A gas cutting torch comprising:

a housing providing an elongate hollow handle portion having front and rear ends;

gas and oxygen entry fittings mounted on the rear end;

a manifold block mounted on the front end;

separate passages for gas and oxygen extending through the handle portion connecting the fittings to the manifold block;

gas and oxygen pipes extending forwardly from the manifold block to join at a cutting tip;

the manifold block being formed with bores interconnecting the respective gas and oxygen passages and pipes;

first and second chambers in the bores interconnecting the gas passage with the gas pipe, the first chamber being located upstream of the second chamber;

a back-fire preventive device releasably mounted in the first chamber;

the second chamber being a gas mixing chamber and having a gas mixing valve mounted therein;

a further bore connecting the oxygen passage with the gas mixing chamber whereby a gas and oxygen mixture is supplied by the gas mixing chamber to the gas pipe; and, a third chamber in the bore interconnecting the oxygen passage and the oxygen pipe, the third chamber having an oxygen jet control valve mounted therein whereby the oxygen jet gas supplied to the oxygen pipe can be adjusted.

2. A gas cutting torch according to claim 1 wherein:

the manifold block has upper and lower faces, mutually opposite side faces and front and rear faces, the gas and oxygen passages from the handle portion connecting to the manifold block at the rear face and the gas and oxygen pipes connecting to the manifold block at the front face, the first chamber opening to a lateral face, the second chamber being formed in a lowermost portion of the block;

a valve adjustment knob is mounted in the second chamber to extend rearwardly from the rear face, adjacent the lower face and below the handle; and, a valve adjustment knob is mounted in the third chamber to upstand from the upper face of the block in front of the handle.

3. A gas cutting torch according to claim 2 wherein:

the manifold block is formed with a further chamber in the bore linking the oxygen supply passage with the oxygen supply valve, the further chamber extending orthogonally to the first chamber and opening to the upper face of the block behind the oxygen valve adjustment knob; and, a second back-fire preventive device is mounted in said further chamber.

4. A gas cutting torch according to claim 1 wherein the back-fire preventive device is made of sintered metal.

5. A gas cutting torch according to claim 1 wherein the handle comprises an outer tubular member providing a gripping surface, an inner tubular member extending longitudinally within the outer tubular member, both members extending longitudinally between the fittings and the rear face of the manifold block, one of the gas and oxygen passages being provided by the inner tubular member and the other of the passages being provided by the space defined between the inner and outer tubular members.

6. A gas cutting torch according to claim 2 wherein:

the manifold block is formed with a further chamber in the bore linking the oxygen supply passage with the oxygen supply valve, the further chamber extending orthogonally to the first chamber and opening to the upper face of the block behind the oxygen valve adjustment knob;

a back-fire preventive device made of sintered metal is mounted in the further chamber;

the handle comprises an outer tubular member providing a gripping surface;

an inner tubular member extends longitudinally within the outer tubular member; and, both members extend longitudinally between the fittings and the rear face of the manifold block, so that one of the gas and oxygen passages is provided by the inner tubular member and the other of the passages is provided by the space defined between the inner and outer tubular members.

* * * * *